US007066712B2

(12) United States Patent
Kim et al.

(10) Patent No.: US 7,066,712 B2
(45) Date of Patent: Jun. 27, 2006

(54) TURBOFAN AND AIR CONDITIONER HAVING THE TURBOFAN

(75) Inventors: Jin Baek Kim, Suwon (KR); Hyoung-Mo Koo, Anyang (KR); Weon-Seok Choi, Songpa-Gu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 201 days.

(21) Appl. No.: 10/748,229

(22) Filed: Dec. 31, 2003

(65) Prior Publication Data

US 2004/0244403 A1 Dec. 9, 2004

(30) Foreign Application Priority Data

Jun. 3, 2003 (KR) ..... 10-2003-0035555

(51) Int. Cl.
*F25D 17/04* (2006.01)

(52) U.S. Cl. ..... 415/58.4; 415/176; 416/181

(58) Field of Classification Search ..... 415/58.4, 415/58.2–58.3, 228; 416/181, 185, 186 R, 416/188; 417/423.1, 370
See application file for complete search history.

(56) References Cited

U.S. PATENT DOCUMENTS

| | | | | |
|---|---|---|---|---|
| 1,919,970 | A | 7/1933 | Woods | |
| 2,482,462 | A | 9/1949 | Browne | |
| 3,842,902 | A * | 10/1974 | Poslusny | 165/51 |
| 6,146,094 | A | 11/2000 | Obana et al. | |
| 6,558,120 | B1 * | 5/2003 | Kim et al. | 416/186 R |
| 6,604,906 | B1 * | 8/2003 | Ozeki et al. | 415/204 |
| 6,746,210 | B1 | 6/2004 | Kim | |
| 6,848,887 | B1 | 2/2005 | Kim | |
| 6,942,459 | B1 | 9/2005 | Li et al. | |
| 2003/0077174 | A1 | 4/2003 | Kim | |

FOREIGN PATENT DOCUMENTS

JP 1-193099 8/1989

OTHER PUBLICATIONS

Korean Patent Abstracts for Publication No. 1020030012623, dated Feb. 12, 2003.
Korean Patent Abstracts for Publication No. 1020020086142, dated Nov. 18, 2002.
Patent Abstracts of Japan for Publication No. 07-016884, dated Jan. 20, 1995.
U.S. Appl. No. 10/748,195, filed Dec. 31, 2003, Jin Baek Kim, et al., Samsung Electronics Co., Ltd., Suwon-si, Republic of Korea.
U.S. Appl. No. 10/748,230, filed Dec. 31, 2003, Jin Baek Kim, et al., Samsung Electronics Co., Ltd., Suwon-si, Republic of Korea.

* cited by examiner

*Primary Examiner*—Edward K. Look
*Assistant Examiner*—Devin Hanan
(74) *Attorney, Agent, or Firm*—Staas & Halsey LLP

(57) ABSTRACT

A turbofan to reduce noise through a suppression of turbulent air flow at an outlet thereof and also to guide the air discharged from the outlet in a specific discharging direction, and an air conditioner equipped with the turbofan to improve an efficiency of a heat exchange. The turbofan includes a rotating plate coupled to a shaft of a drive motor, a plurality of blades radially arranged on a peripheral area of a front face of the rotating plate, a ring-shaped shroud joining to ends of the plurality of blades, and a flow guide rib extending from a peripheral edge of the rotating plate in a rearward direction to guide the air discharged from the turbofan.

25 Claims, 5 Drawing Sheets

TURBOFAN AND AIR CONDITIONER HAVING THE TURBOFAN

CROSS-REFERENCE TO RELATED APPLICATION

This application cairns the benefit of Korean Application No. 2003-35555, filed Jun. 3, 2003, in the Korean Intellectual Property Office, the disclosure of which is incorporated herein by reference.

BACKGROUND OF THE INVENTION

1. Field of the Invention

The present invention relates to a turbofan and an air conditioner having the turbofan, and more particularly, to a turbofan and an air conditioner having the turbofan, which is designed to reduce flow noise at an outlet of the turbofan and to allow air to be smoothly discharged.

2. Description of the Related Art

Generally, a turbofan is a kind of centrifugal fan, which is adapted to radially blow air by rotating blades. The turbofan is applied to a typical air conditioner to blow the air in a desired direction.

FIG. 1 is a cross-sectional view showing an indoor unit of a conventional ceiling type air conditioner, which is equipped with a turbofan. As shown in FIG. 1, the indoor unit of the ceiling type air conditioner includes a case body 2 embedded in a ceiling 1, and a ceiling panel 3 disposed in a lower opening of the case body 2. The case body 2 is provided therein with a turbofan 4, a drive motor 5 to rotate the turbofan 4, and a heat exchanger 6 surrounding the turbofan 4.

The ceiling panel 3, which is provided at a lower face of the case body 2, includes a central inlet 7 formed at a center thereof to draw indoor air, and an outlet 8 formed around the central inlet 7. The central inlet 7 of the ceiling panel 3 is provided with a filter 9 to dean the indoor air drawn therethrough. The ceiling panel 3 is provided above the filter 9 with an air-guide plate 10 having a central opening 10*a* to guide the indoor air drawn through the filter 9 toward the turbofan 4.

In an operation of the ceiling type air conditioner, as the turbofan 4 rotates by the drive motor 5, the indoor air is drawn into a center of the turbofan 4 through the central inlet 7 of the ceiling panel 3, and the indoor air is radially discharged toward the heat exchanger 6. The indoor air radially discharged from the turbofan 4 is cooled while passing through the heat exchanger 6, and the cool air is again supplied to an interior through the outlet 8.

To cool the drive motor 5 to drive the turbofan 4, the turbofan 4 is positioned such that a rear face of the turbofan 4 is spaced apart from an inner surface 2*a* of the top plate of the case body 2 by a specific distance, thereby defining a cooling path 11 therebetween. Furthermore, the turbofan 4 is formed at a center area thereof with circulation holes 12 to allow the cool air to be circulated therethrough. A part of the indoor air, radially discharged from the turbofan 4, serves to cool the drive motor 5 while being circulated (in a direction of an arrow A) through the cooling path 11 defined by the rear face of the turbofan 4 and the circulation holes 12.

As such, in the conventional ceiling type air conditioner having the turbofan 4, a part of cooling air, which is radially discharged from the outlet 8 at a high speed, flows along the rear face of the turbofan 4, and the relatively large cooling path 11 is defined between the rear face of the turbofan 4 and the inner surface 2*a* of the top plate of the case body 2. Thus, since the part of cooling air discharged from the outlet 8 of the turbofan 4 is separated from a supply of main air discharged from the outlet 8, violent turbulent air flow is generated in a region where the air is separated, thereby creating noise.

To overcome the above problems, to cool the drive motor 5 while reducing turbulent air flow by reducing a spacing between the rear face of the turbofan 4 and the inner surface 2*a* of the top plate is possible. However, in this case, since the air discharged from the outlet 8 of the turbofan 4 largely concentrates at an upper portion of the heat exchanger 6, an efficiency of heat exchange is lowered.

SUMMARY OF THE INVENTION

Accordingly, it is an aspect of the present invention to provide a turbofan, which is designed not only to reduce noise by a suppression of turbulent air flow at an outlet thereof, but also to guide air discharged from the outlet in a specific discharging direction, and an air conditioner which is equipped with the turbofan to improve an efficiency of heat exchange.

Additional aspects and/or advantages of the invention will be set forth in part in the description which follows and, in part, will be obvious from the description, or may be learned by practice of the invention.

The above and/or other aspects are achieved by providing a turbofan including a rotating plate coupled at a center thereof to a shaft of a drive motor, a plurality of blades radially arranged on a peripheral area of a front face of the rotating plate, a ring-shaped shroud joined to ends of the plurality of blades, and a flow guide rib extending from a peripheral edge of the rotating plate in a rearward direction to guide air discharged from the turbofan.

The above and/or other aspects are achieved by providing a turbofan including a rotating plate coupled at a center thereof to a shaft of a drive motor, a plurality of blades radially arranged on a peripheral area of a front face of the rotating plate, a ring-shaped shroud joined to ends of the plurality of blades, and a flow guide rib extending from a peripheral edge of the rotating plate in a rearward and outward direction to guide the air discharged from the turbofan.

The above and/or other aspects are achieved by providing an air conditioner including a case body, a drive motor fixed to an inner surface of the case body, a turbofan coupling to a shaft of the drive motor, and having a rotating plate coupling at a center thereof to the shaft of the drive motor, a plurality of blades radially arranged on a peripheral area of a front face of the rotating plate, a ring-shaped shroud joining to ends of the plurality of blades, and a flow guide rib extending in a rearward direction from a peripheral edge of the rotating plate toward an inner surface of the case body to guide air discharged from the turbofan, and a heat exchanger disposed around the turbofan in the case body.

The above and/or other aspects are achieved by providing an air conditioner including a case body, a drive motor fixed to an inner surface of the case body, a turbofan coupling to a shaft of the drive motor, and having a rotating plate coupling at a center thereof to the shaft of the drive motor, a plurality of blades radially arranged on a peripheral area of a front face of the rotating plate, a ring-shaped shroud joining to ends of the plurality of blades, and a flow guide rib extending from a peripheral edge of the rotating plate in a rearward and outward direction to guide air discharged from the turbofan, and a heat exchanger disposed around the turbofan in the case body.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
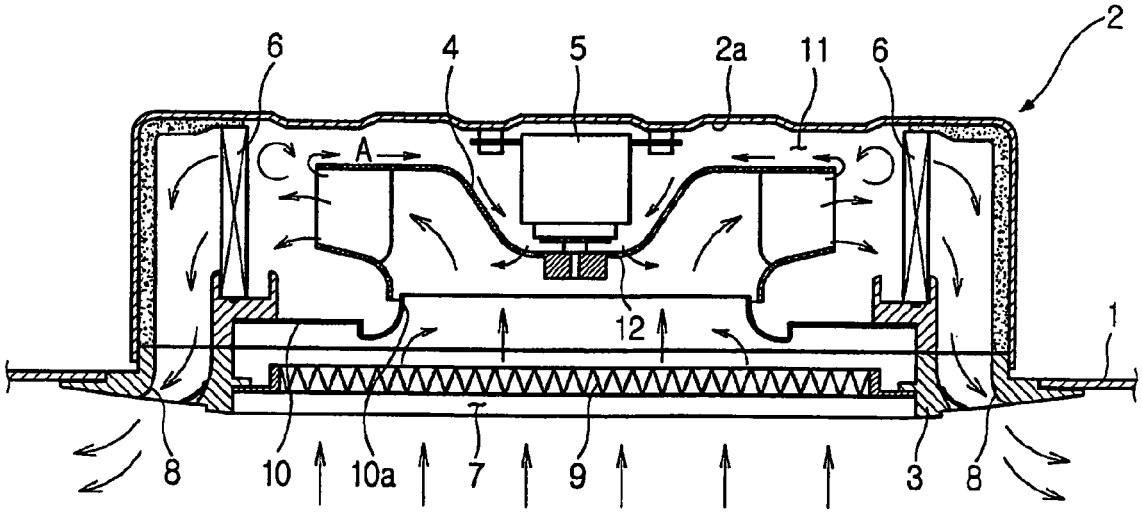
FIG. 1 PRIOR ART
FIG. 1 is a cross-sectional view of an air conditioner equipped with a conventional turbofan.
Figure 2:
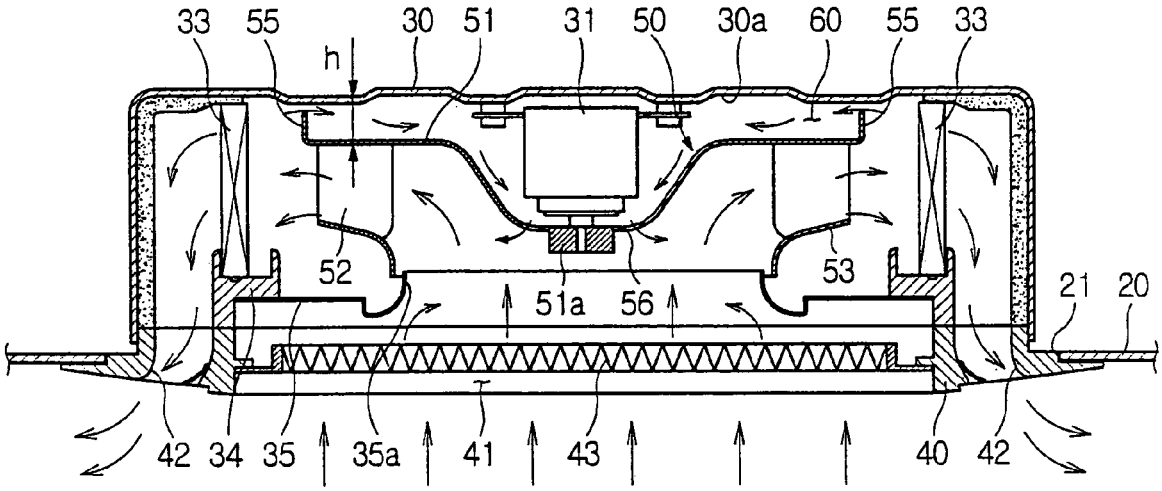
FIG. 2 is a cross-sectional view of an air conditioner equipped with a turbofan, according to a first embodiment of the present invention.

Reference will now be made in detail to the present preferred embodiments of the present invention, examples of which are illustrated in the accompanying drawings, wherein like reference numerals refer to like elements throughout FIG. 2 is a cross-sectional view showing a ceiling type air conditioner, which is equipped with a turbofan, according to a first embodiment of the present invention. As shown in FIG. 2, the air conditioner includes a box-shaped case body 30 embedded in a ceiling 20 and opening at a lower face thereof, and a ceiling panel 40 installed at the lower opening of the box-shaped case body 30 and having a flange attached to a peripheral edge of a ceiling opening 21.

The box-shaped case body 30 is provided therein with a turbofan 50 to circulate indoor air by drawing the indoor air and radially discharging the indoor air, and a drive motor 31 to rotate the turbofan 50. The drive motor 31 is secured to an inner surface 30*a* of a top plate of the box-shaped case body 30. The box-shaped case body 30 is further provided therein with a rectangular tube-shaped heat exchanger 33 surrounding the turbofan 50 to exchange heat with the indoor air discharged from the turbofan 50. The rectangular tube-shaped heat exchanger 33 is provided thereunder with a tray 34 to collect condensation resulting from a heat exchange and to discharge the condensation. The tray 34 is supported on the ceiling panel 40.

The ceiling panel 40 is provided at a center thereof with an inlet 41 to allow the indoor air to be drawn therethrough. The ceiling panel 40 is further provided around the inlet 41 with a plurality of elongated outlets 42. A filter 43 is installed in the inlet 41 of the ceiling panel 40 to dean the indoor air, and a guide plate 35 having a central opening 35*a* is provided above the filter 43 to guide the indoor air drawn through the filter 43 toward a center of the turbofan 50. The guide plate 35 is secured to the tray 34 at a peripheral edge thereof.

Figure 3:
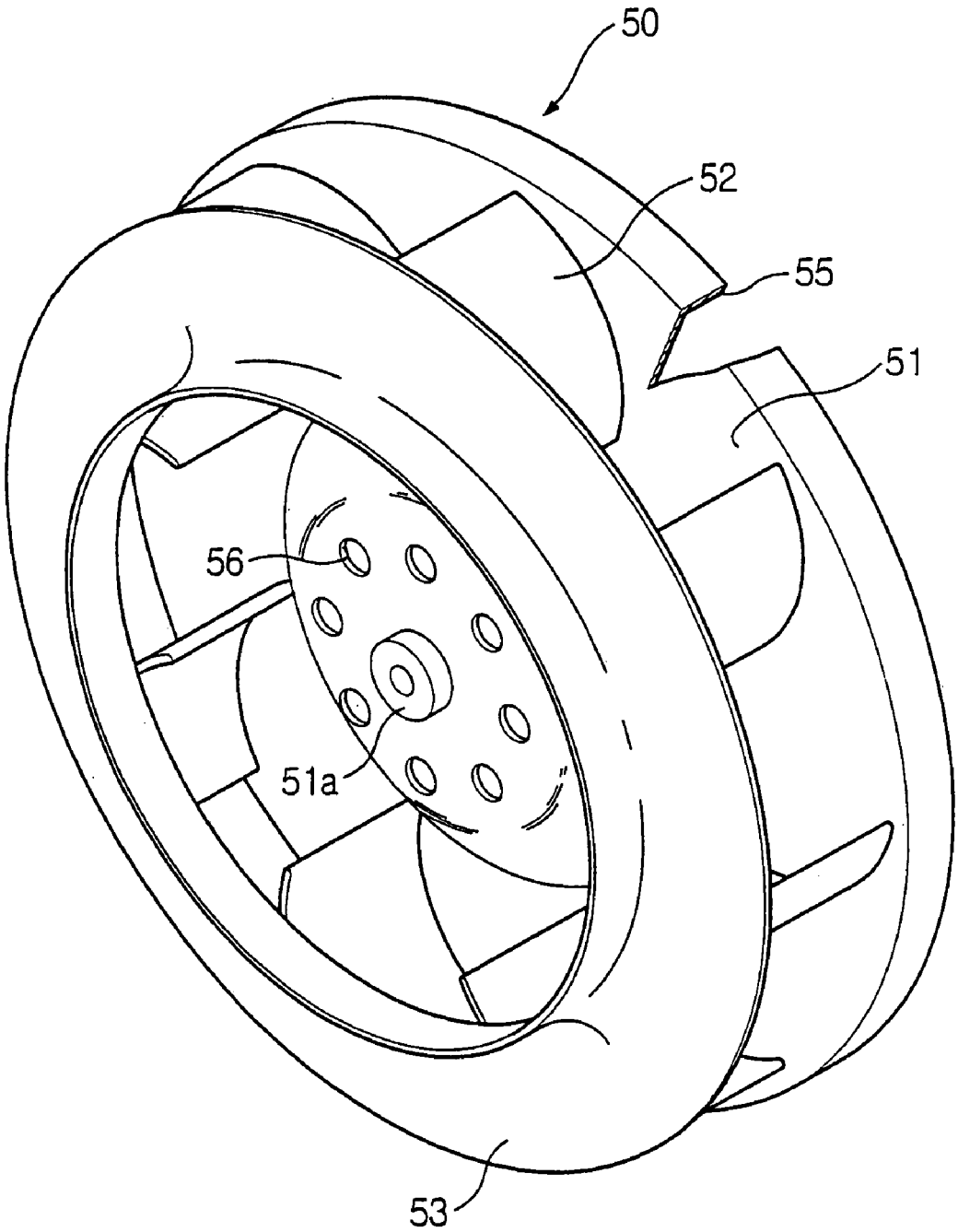
FIG. 3 is a perspective view of the turbofan shown in FIG. 2.

As shown in FIGS. 2 and 3, the turbofan 50 installed in the case body 30 includes a circular rotating plate 51 integrally formed with a central hub 51*a* into which a shaft of the drive motor 31 fits, and a plurality of blades 52 radially arranged on a peripheral area of a front face of the circular rotating plate 51. The turbofan further includes a ring-shaped shroud 53 joining to ends of the plurality of blades 52 with a spacing between the circular rotating plate 51 and the ring-shaped shroud 53, so as to support the ends of the plurality of blades 52 and to guide air flow.

As shown in FIG. 2, when the turbofan 50 is installed in the box-shaped case body 30 of the ceil type air conditioner, a rear surface of the circular rotating plate 51 of the turbofan 50 is spaced apart from the inner surface 30*a* of the box-shaped case body 30 by a predetermined gap h, such that an outlet of the turbofan 50 is positioned at a middle portion of the rectangular tube-shaped heat exchanger 33. Accordingly, the indoor air discharged from the turbofan 50 is evenly distributed over a whole area of the rectangular tube-shaped heat exchanger 33, thereby improving an efficiency of a heat exchange.

As shown in FIGS. 2 and 3, the turbofan 50 includes a flow guide rib 55, which is bent in a rearward direction at a peripheral portion of the circular rotating plate 51 and extending in the rearward direction, i.e., toward the inner surface 30*a* of the box-shaped case body 30, so as to guide the indoor air discharged from the turbofan 50 toward the rectangular tube-shaped heat exchanger 33. Thus, since the flow guide rib 55 restricts air entering a flow path 60 defined between the rear surface of the turbofan 50 and the inner surface 30*a* of the box-shaped case body 30, indoor air radially discharged from the outlet of the turbofan 50 is smoothly guided to the rectangular tube-shaped heat exchanger 33, thereby preventing generation of a turbulent air flow, and thus preventing noise due to the turbulent air flow.

Furthermore, to cool the drive motor 31 by allowing the indoor air discharged from the turbofan 50 to flow into the flow path 60 defined between the rear surface of the turbofan 50 and the inner surface 30*a* of the box-shaped case body 30, the flow guide rib 55 is slightly spaced apart from the inner surface 30*a* of the box-shaped case body 30, and the circular rotating plate 51 of the turbofan 50 is formed at a center area with a plurality of circulation holes 56 to allow the indoor air to be circulated therethrough. As a result, the indoor air radially discharged from the turbofan 50 is partially introduced into the flow path 60 and then passes over the drive motor 31, thereby cooling the drive motor 31 by the indoor air.

Operations of the ceiling type air conditioner equipped with the turbofan 50, according to the first embodiment of the present invention will now be described.

As the turbofan 50 rotates by the drive motor 31, indoor air, drawn through the inlet 41 of the ceiling panel 40, passes through the filter 43, and then is introduced to the center of the turbofan 50 through the central opening 35*a* of the guide plate 35. The indoor air, which is introduced to the center of the turbofan 50, is radially discharged from the turbofan 50 toward the rectangular tube-shaped heat exchanger 33 by a rotation of the turbofan 50. The indoor air, which is discharged from the turbofan 50, cools while passing through the rectangular tube-shaped heat exchanger 33, and is discharged into an indoor space through the plurality of elongated outlets 42 provided around the ceiling panel 40, thereby cooling the indoor space.

Since a majority of the indoor air discharged from the outlet of the turbofan 50 does not flows to the rear face of the turbofan 50 but instead is guided toward the rectangular tube-shaped heat exchanger 33 by the flow guide rib 55, minimal turbulent air flow (eddy flow) occurs near the outlet of the turbofan 50, thereby enabling a quiet operation of the ceiling type air conditioner.

A part of the indoor air discharged from the outlet of the turbofan 50 flows toward the drive motor 31 through the flow path 60 defined between the flow guide rib 55 and the rear surface of the turbofan 50 and the inner surface 30*a* of the box-shaped case body 30 to cool the drive motor 31. Since a part of the indoor air flows toward the drive motor 31 through the flow path 60, which is narrow, between the flow guide rib 55 and the rear surface of the turbofan 50 and the inner surface 30*a* of the box-shaped case body 30, the indoor air flowing into the flow path 60 does not affect a normal flow of the indoor air discharged from the outlet of the turbofan 50.

Figure 4:
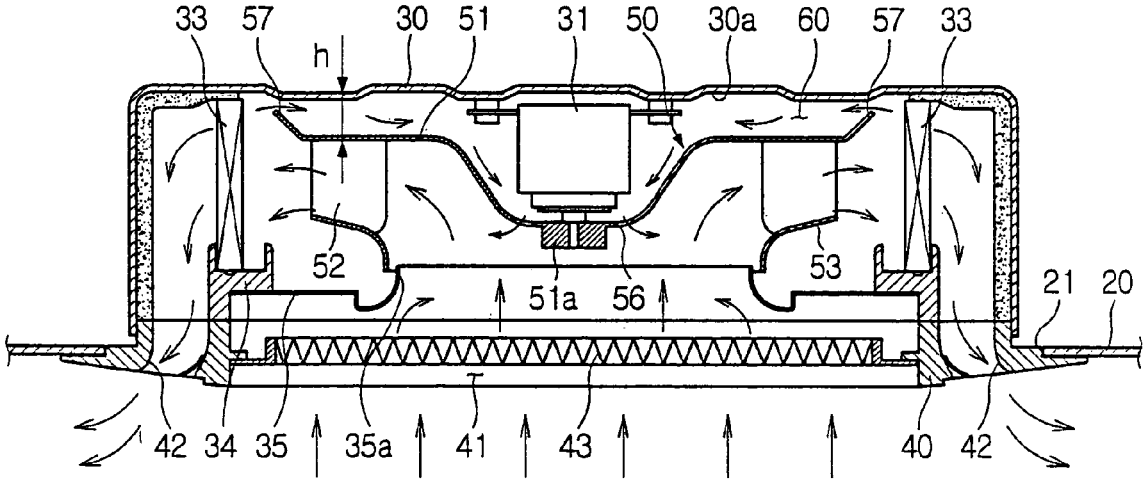
FIG. 4 is a cross-sectional view of an air conditioner equipped with a turbofan, according to a second embodiment of the present invention.
Figure 5:
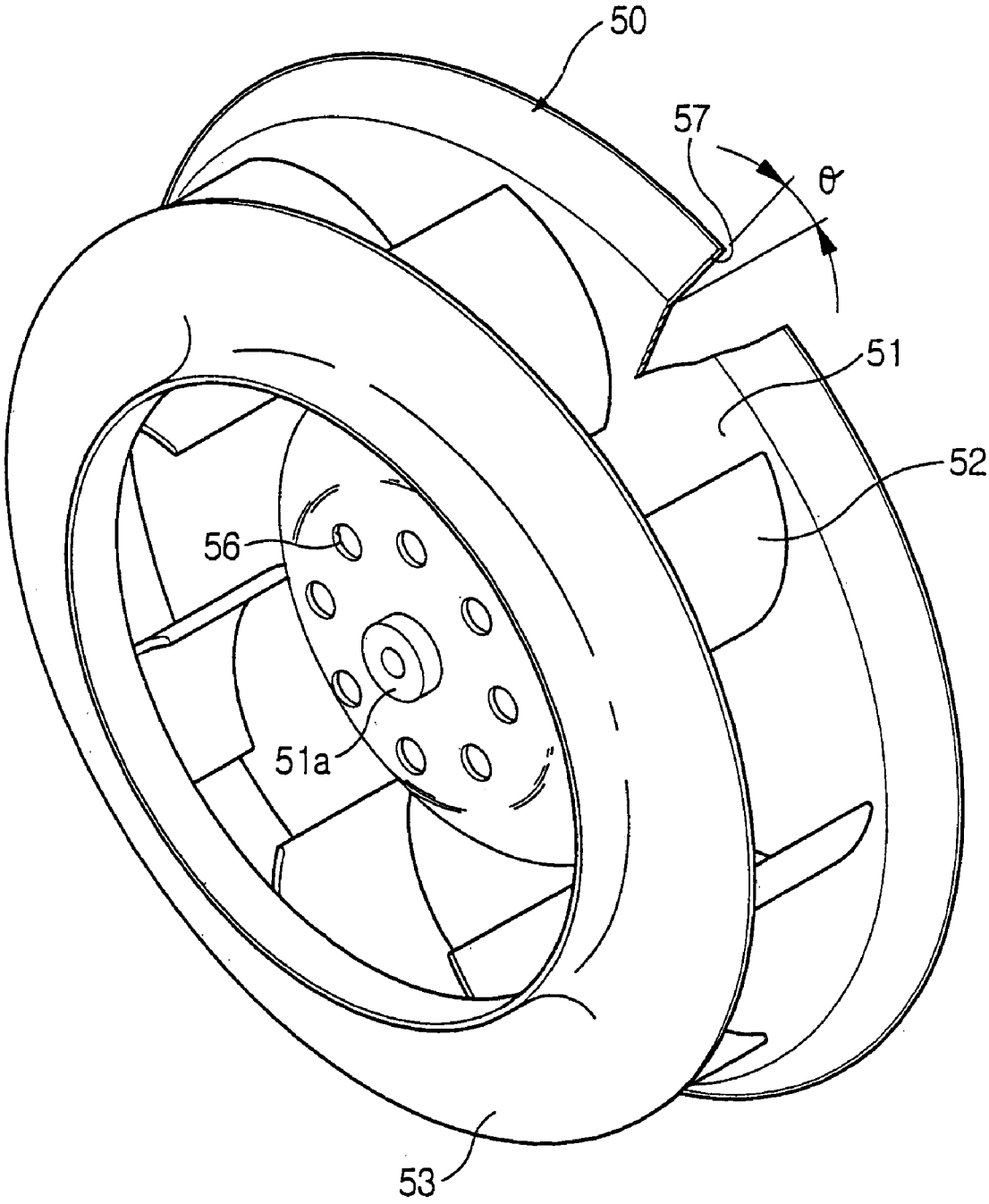
FIG. 5 is a perspective view of the turbofan shown in FIG. 4.

FIG. 4 is a cross-sectional view showing a ceiling type air conditioner, which is equipped with a turbofan, according to a second embodiment of the present invention, and FIG. 5 is a perspective view of the turbofan shown in FIG. 4. As shown in FIGS. 4 and 5, the turbofan 50 is designed such that a flow guide rib 57 formed at a peripheral edge of the circular rotating plate 51 of the turbofan 50 is inclined in an outward direction by a predetermined angle (•) with respect to an axis of the turbofan 50. A majority of the indoor air discharged from the turbofan 50 does not flow to the rear face of the turbofan 50 by the flow guide rib 57 but is more efficiently guided toward the rectangular tube-shaped heat exchanger 33. Therefore, there is no turbulent air flow near the outlet of the turbofan 50. Since components other than the flow guide rib 57 and operations thereof are substantially equal to those of the first embodiment, descriptions relating to the components are omitted.

As is apparent from the above description, a turbofan is provided, in which a rotating plate is provided at a peripheral edge thereof with a flow guide rib to suppress turbulent airflow of air discharged from the turbofan, thereby reducing noise due to the turbulent air flow.

Further, even though a rear face of the turbofan is spaced apart from an inner surface of a case body of an air conditioner such that an outlet of the turbofan is positioned at a middle portions of a heat exchanger, an air flow of air discharged from the turbofan into a flow path behind the turbofan is suppressed by the flow guide rib provided at the peripheral edge of the turbofan. Accordingly, since the air discharged from the turbofan is efficiently guided to the heat exchanger, an efficiency of a heat exchange of an air conditioner equipped with the turbofan improves.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A turbofan with a drive motor comprising:

a rotating plate having a front face coupled at a center thereof to a shaft of the drive motor;

a plurality of blades radially arranged on a peripheral area of the front face of the rotating plate;

a ring-shaped shroud joining to ends of the plurality of blades; and a flow guide rib extending from a peripheral edge of the rotating plate in a rearward direction to guide air discharged from the turbofan.

2. An air conditioner, comprising:

a drive motor; and a turbofan, comprising:

a rotating plate having a front face coupled at a center thereof to a shaft of the drive motor, a plurality of blades radially arranged on a peripheral area of the front face of the rotating plate, a ring-shaped shroud joining to ends of the plurality of blades, and a flow guide rib extending from a peripheral edge of the rotating plate in a rearward direction to guide air discharged from the turbofan.

3. A turbofan with a drive motor comprising:

a rotating plate having a front face coupled at a center thereof to a shaft of the drive motor;

a plurality of blades radially arranged on a peripheral area of the front face of the rotating plate;

a ring-shaped shroud joining to ends of the plurality of blades; and a flow guide rib extending from a peripheral edge of the rotating plate in rearward and outward directions to guide air discharged from the turbofan.

4. An air conditioner, comprising:

a drive motor; and a turbofan, comprising:

a rotating plate having a front face coupled at a center thereof to a shaft of the drive motor, a plurality of blades radially arranged on a peripheral area of the front face of the rotating plate, a ring-shaped shroud joining to ends of the plurality of blades, and a flow guide rib extending from a peripheral edge of the rotating plate in rearward and outward directions to guide the air discharged from the turbofan.

5. An air conditioner comprising:

a case body;

a drive motor fixed to an inner surface of the case body;

a turbofan coupled to a shaft of the drive motor, and including a rotating plate coupled at a center thereof to the shaft of the drive motor, a plurality of blades radially arranged on a peripheral area of a front face of the rotating plate, a ring-shaped shroud joining to ends of the plurality of blades, and a flow guide rib extending in a rearward direction from a peripheral edge of the rotating plate toward an inner surface of the case body to guide air discharged from the turbofan; and a heat exchanger disposed around the turbofan in the case body.

6. An air conditioner comprising:

a case body;

a drive motor fixed to an inner surface of the case body;

a turbofan coupled to a shaft of the drive motor, and including a rotating plate coupled at a center thereof to the shaft of the drive motor, a plurality of blades radially arranged on a peripheral area of a front face of the rotating plate, a ring-shaped shroud joining to ends of the plurality of blades, and a flow guide rib extending from a peripheral edge of the rotating plate in rearward and outward directions to guide air discharged from the turbofan; and a heat exchanger disposed around the turbofan in the case body.

7. A turbofan with a drive motor comprising:

a rotating plate coupled to the drive motor to rotate the rotating plate;

a plurality of blades radially arranged on a front face of the rotating plate;

a shroud joining to ends of the plurality of blades; and a flow guide rib extending from a peripheral edge of the rotating plate in one of an axial direction and of axial and radial directions to guide air discharged from the turbofan.

8. The turbofan according to claim 7, wherein the air discharged from the turbofan is discharged therefrom in a radial direction by the flow guide rib to suppress a turbulent air flow of the air discharged from the turbofan.

9. The turbofan according to claim 7, further comprising:

a central hub into which a shaft of the drive motor fits, the rotating plate integrally formed with the central hub, the shroud being joined to the ends of the plurality of blades with a spacing between the rotating plate and the shroud so as to support the ends of the plurality of blades.

10. The air conditioner according to claim 7, wherein the flow guide rib of the turbofan is bent at the peripheral edge of the rotating plate of the turbofan to be inclined at a predetermined angle with respect to an axis of the turbofan.

11. The air conditioner according to claim 7, wherein the rotating plate of the turbofan is formed at a center area with a plurality of circulation holes to allow air to be circulated therethrough to cool the drive motor.

12. An air conditioner, comprising:

a drive motor; and a turbofan, comprising:

a rotating plate coupled to the drive motor to rotate the rotating plate;

a plurality of blades radially arranged on a front face of the rotating plate;

a shroud joining to ends of the plurality of blades; and a flow guide rib extending from a peripheral edge of the rotating plate in one of a rearward direction and of an axial direction and a radial direction to guide air discharged from the turbofan.

13. An air conditioner comprising:

a case body to attach to surface member;

a drive motor fixed to the case body;

a turbofan coupled the drive motor to drive the turbofan, and comprising:

a rotating plate to rotate in the turbofan, a plurality of blades radially arranged on a peripheral area of the rotating plate, a shroud joining to ends of the plurality of blades, and a flow guide rib extending from a peripheral edge of the rotating plate in one of an axial direction and of an axial direction and a radial direction to guide air discharged from the turbofan; and a heat exchanger disposed around the turbofan in the case body.

14. The air conditioner according to claim 13, wherein the air discharged from the turbofan is discharged therefrom in a radial direction by the flow guide rib to suppress a turbulent air flow of the air discharged from the turbofan.

15. The air conditioner according to claim 13, wherein the case body further comprises a flange disposed at the lower face of the case body to be attached to a peripheral edge of a mounting surface.

16. The air conditioner according to claim 13, wherein the heat exchanger is rectangular and tube-shaped to surround the turbofan and to exchange heat with the air discharged from the turbofan.

17. The air conditioner according to claim 13, further comprising:

a tray provided under the heat exchanger, to collect condensation resulting from heat exchange and to discharge the condensation.

18. The air conditioner according to claim 13, further comprising:

a panel comprising an inlet provided at a center thereof to allow the air to be drawn through the inlet, and a plurality of elongated outlets provided around the inlet;

a filter provided in the inlet of the panel to clean the air being drawn through the inlet; and a guide plate having a central opening provided adjacent to the filter to guide the air drawn through the filter toward a center of the turbofan.

19. The air conditioner according to claim 13, wherein:

the drive motor comprises:

a shaft to drive the turbofan; and the turbofan further comprises:

a central hub into which the shaft of the drive motor fits, the rotating plate integrally formed with the central hub, the shroud being joined to the ends of the plurality of blades with a spacing between the rotating plate and the shroud so as to support the ends of the plurality of blades.

20. The air conditioner according to claim 13, wherein a rear surface of the rotating plate of the turbofan is spaced apart from the inner surface of the case body by a predetermined gap such that an outlet of the turbofan is positioned at a middle portion of the heat exchanger to distribute the air discharged from the turbofan over an entire area of the heat exchanger.

21. The air conditioner according to claim 13, wherein the flow guide rib of the turbofan is bent in one of a rearward direction and of rearward and outward directions at a peripheral portion of the rotating plate, toward the inner surface of the case body.

22. The air conditioner according to claim 13, wherein the flow guide restricts air entering a flow path defined between a rear surface of the turbofan and an inner surface of the case body while allowing a portion of the air discharged by the turbofan to enter the flow path to cool the drive motor.

23. The air conditioner according to claim 13, wherein the rotating plate of the turbofan is formed at a center area with a plurality of circulation holes to allow air to be circulated therethrough to cool the drive motor.

24. The air conditioner according to claim 22, wherein a majority of the air discharged is guided toward the heat exchanger by the flow guide rib and away from the flow path defined between the rear surface of the turbofan and the inner surface of the case body so that substantially no turbulent air flow occurs near an outlet of the turbofan.

25. The air conditioner according to claim 13, wherein the flow guide rib formed at the peripheral edge of the rotating plate of the turbofan is inclined at a predetermined angle with respect to an axis of the turbofan.

* * * * *

UNITED STATES PATENT AND TRADEMARK OFFICE

CERTIFICATE OF CORRECTION

PATENT NO. : 7,066,712 B2
APPLICATION NO. : 10/748229
DATED : June 27, 2006
INVENTOR(S) : Jin Baek Kim et al.

It is certified that error appears in the above-identified patent and that said Letters Patent is hereby corrected as shown below:

Column 7, Line 31, after "coupled" insert --to--.

Column 7, Line 38-39, after "direction and" delete "of an axial direction and".

Signed and Sealed this

Twenty-seventh Day of February, 2007

JON W. DUDAS
*Director of the United States Patent and Trademark Office*